United States Patent [19]

Shemitz

[11] Patent Number: 4,549,249

[45] Date of Patent: Oct. 22, 1985

[54] OVERHEAD LIGHTING SYSTEM FOR ONE OR MORE VISUAL DISPLAY TERMINALS

[75] Inventor: Sylvan R. Shemitz, Woodbridge, Conn.

[73] Assignee: Sylvan R. Shemitz and Associates, Inc., West Haven, Conn.

[21] Appl. No.: 631,636

[22] Filed: Jul. 17, 1984

[51] Int. Cl.[4] ..... A61G 13/00

[52] U.S. Cl. ..... 362/33; 362/127

[58] Field of Search ..... 362/33, 279, 225, 236, 362/297, 247, 248, 249, 223, 225; 240/73, 2, 51.11

[56] References Cited

U.S. PATENT DOCUMENTS

| | | | |
|---|---|---|---|
| 1,138,503 | 5/1915 | Persons . | |
| 2,337,437 | 12/1943 | Allen | 362/225 |
| 2,590,192 | 3/1952 | Logan | 362/33 |
| 2,621,285 | 12/1952 | Nitardy | 362/225 |
| 3,265,804 | 8/1966 | Berger et al. | 174/35 |
| 3,860,903 | 1/1975 | Van Doenhoven | 362/279 |
| 3,967,107 | 6/1976 | Junginger et al. | 362/33 |
| 4,006,355 | 2/1977 | Shemitz et al. | 240/51.11 R |
| 4,054,793 | 10/1977 | Shemitz | 362/127 |
| 4,059,754 | 11/1977 | Lewin | 362/217 |
| 4,122,511 | 10/1978 | Petersen | 362/351 |
| 4,173,034 | 10/1979 | Shemitz | 362/98 |
| 4,233,651 | 11/1980 | Fabbri | 362/33 |
| 4,300,185 | 11/1981 | Wakamatsu | 362/33 |
| 4,368,504 | 1/1983 | Sato et al. | 362/33 |
| 4,414,609 | 11/1983 | Shemitz | 362/33 |

*Primary Examiner*—Raymond A. Nelli

*Attorney, Agent, or Firm*—Eugene S. Indyk

[57] ABSTRACT

An overhead lighting system for one or more visual display terminals includes one or more luminous elements and a baffle having a series of rails mounted at least partially below the luminous element. The baffle reduces reflections of overhead surfaces, especially the lighting equipment and the ceiling, in the screen of the visual display terminals while economically maintaining comfortable lighting. The overhead lighting system provides greater comfort and productivity of personnel who utilize visual display terminals. It is particularly, but not solely, suited to computer classrooms, stock brokerage firms, or other large areas where one or more visual display terminals are used in an open environment.

14 Claims, 13 Drawing Figures

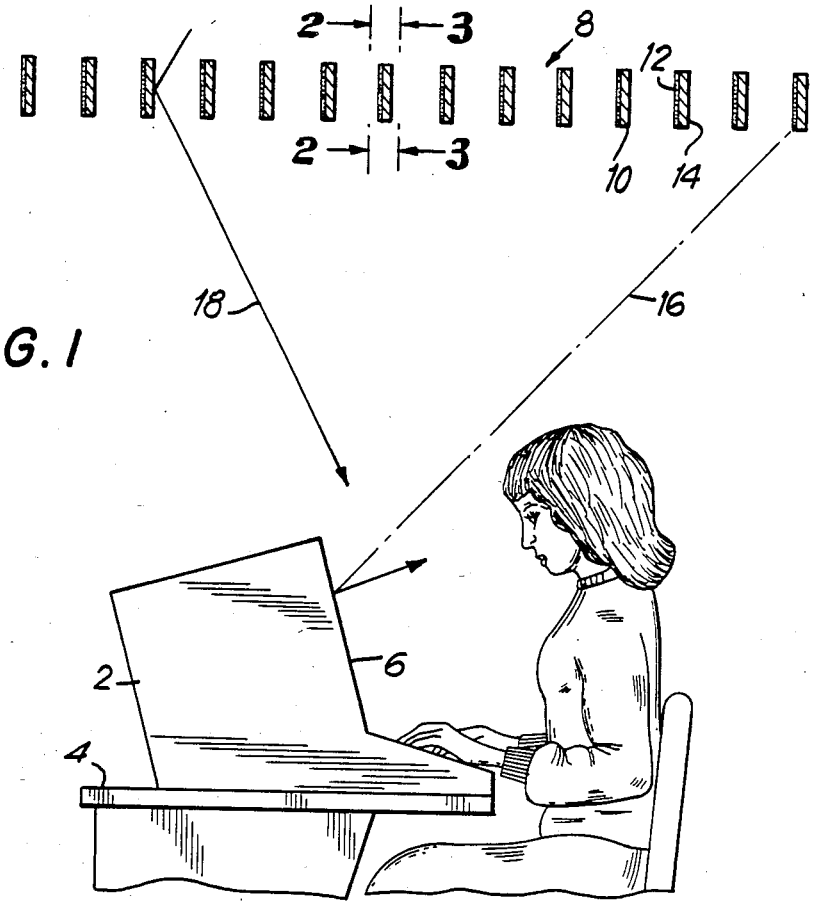
FIG. 1
FIG. 2
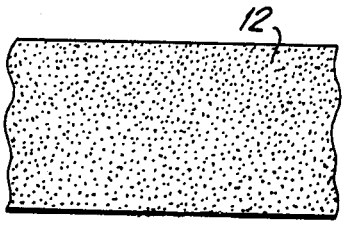
FIG. 3
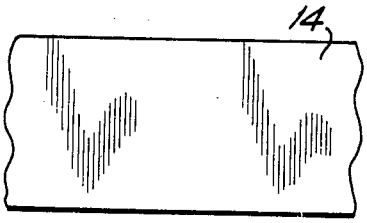

OVERHEAD LIGHTING SYSTEM FOR ONE OR MORE VISUAL DISPLAY TERMINALS

BACKGROUND OF THE INVENTION

This invention relates to lighting for a visual display terminal. More particularly, this invention relates to overhead lighting for a visual display terminal which reduces reflections from the visual display terminal screen caused by the surroundings of the visual display terminal.

Visual display terminals portray information on screens having specular surfaces such as glass or other such material. The surfaces of these materials, however, reflect bright surroundings near the visual display terminal into the eyes of the visual display terminal operator. This can result in eye strain and operator fatigue from reduced contrast and camouflaging images from reflections that inhibit reading the information displayed on the screen. Bright overhead areas such as ceilings and light fixtures are particularly likely to produce such reflections. As discussed below, this invention reduces these reflections by provision of a novel lighting system for visual display terminals.

Shemitz U.S. Pat. No. 4,414,609 describes a work station lighting system for a visual display terminal. It includes a shield which prevents light reflections from the visual display terminal screen caused by light striking and brightening light colored clothing worn by the operator. Contrast between the characters displayed on the screen and the background of the screen is thereby enhanced. This patent, however, does not address the problem of light reflections caused by the surroundings of the visual display terminal, particularly the ceiling and other overhead areas of the space in which the visual display terminal is situated.

SUMMARY OF THE INVENTION

It is an object of the present invention to provide an overhead lighting system for one or more visual display terminals.

It is another object of the invention to provide a ceiling lighting system for one or more visual display terminals.

It is also an object of the present invention to provide a lighting system for one or more visual display terminals which reduces light reflections from the ceiling and overhead areas of a space where one or more visual display terminals are situated while maintaining a sufficient lighting level.

It is another object of the invention to provide a lighting system for one or more visual display terminals which is free of veiling reflections.

It is still another object of the invention to provide a lighting system for one or more visual display terminals which provides a comfortable lighting level, is efficient and economical, and offers the lighting designer many options in designing a lighting system.

It is another object of the present invention to provide a lighting system for one or more visual display terminals which prevents camouflaging images in the screen of the visual display terminal.

It is another object of the present invention to provide a lighting system for one or more visual display terminals which maintains adequate oontrast between the characters displayed on the visual display terminal screen and the background of the screen.

In accordance with these objects, a lighting system is provided which includes a luminous element mounted above one or more visual display terminals, each of which has a display screen facing in a single predetermined direction in a space where the one or more visual display terminals are situated. The lighting system further includes a baffle mounted so that the luminous element is located above the bottom edge of the baffle and which comprises a series of generally parallel rails, each rail disposed generally parallel to the face of the display screen. The rails each have first and second surfaces. The first surface of each rail is darkly colored to minimize light reflections from the screen of one or more visual display terminals situated below the rails. The second surface of each rail is lightly colored to reflect light from the luminous element.

BRIEF DESCRIPTION OF THE DRAWINGS

FIG. 1 is a schematic view of one embodiment of the present invention showing the relationship between the baffle, visual display terminal, and operator.

FIG. 2 is a view taken along line 2—2 in FIG. 1.

FIG. 3 is a view taken along line 3—3 in FIG. 1.

DETAILED DESCRIPTION OF THE INVENTION

Figure 4:
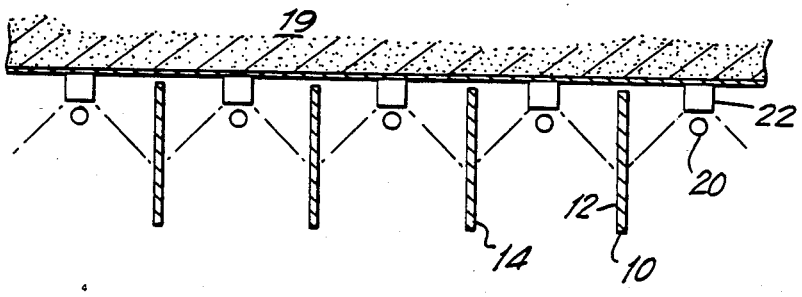
FIG. 4 shows another embodiment of the present invention having a baffle and a linear light source suspended from the ceiling.

The general prinoiples of the invention will now be discussed with reference to FIGS. 1–3. FIG. 1 shows a visual display terminal 2 situated on a horizontal work surface 4. The screen 6 of the visual display terminal faces in a predetermined direction in a space where the visual display terminal is located. Mounted above the visual display terminal is a baffle 8 comprising a series of rails 10 disposed generally parallel to the plane formed by the visual display terminal screen. Each rail has a first surface 12 and a second surface 14. As shown in FIG. 2, the first surface 12 of each rail is light absorptive (i.e., darkly colored, for example, black) and as shown in FIG. 3, the second surface 14 of each rail is light reflective (i.e., lightly colored, for example, white). The rails can be made of any material, for example, wood, metal, fabric, or plastic.

FIG. 1 shows only one visual display terminal, but the invention also is applicable to more than one visual display terminal, each of which has its screen oriented with respect to the baffle as shown in FIG. 1.

In accordance with the invention, and as exemplarily depicted in the embodiments shown in FIGS. 4–13 below, a luminous element (not shown in FIG. 1) is situated above the bottom edge of the baffle 8. That is, the baffle is at least partially below the luminous element. The luminous element can be a primary light source, for example, a linear light source such as a fluorescent tube. Suitable primary light sources also include point and area sources. The luminous element can also be a secondary light source, for example, a reflective surface or luminous plane created by reflected light or transillumination above the baffle. The secondary light source can be, for example, a reflective ceiling or a primary light source directing its light through a lens or a diffuser.

As shown in FIG. 1, the screen reflects only the dark surface 12 of each rail, as illustrated for example, by line 16. This reduces undesirable light reflections from the screen, for example, reflections of the ceiling, the baffle, the light source and any reflector associated with the light source. At the same time, adequate contrast is maintained between the characters displayed on the screen and the background of the screen. Thus, information displayed on the screen is easier to read and the eye strain and fatigue of the operator caused by camouflaging images is reduced. At the same time, the light colored surfaces 14 reflect light from luminous elements (not shown) so as to maintain adequate lighting, as illustrated, for example, by line 18.

As more clearly shown in the embodiments of the invention discussed in greater detail below, the baffle reduces reflections in the visual display terminal screen of light sources and overhead room surfaces. It provides greater comfort and productivity of personnel who utilize visual display terminals. It is particularly, but not solely, suited to computer classrooms, stock brokerage firms, or other large areas where one or more visual display terminals are used in an open environment.

FIG. 4 shows a baffle similar to the baffle of FIG. 1 suspended from or below a ceiling 19 in any well-known manner. In this embodiment and in all the alternative embodiments of the invention described below, the light and dark surfaces of the baffle are oriented with respect to the operator and the visual display terminal as in FIG. 1. Supported between rails of the baffle are linear light sources 20, for example, fluorescent tubes, with associated support structure 22 running parallel to the rails of the baffle. In this embodiment, both the light sources and the baffle are located in relatively close proximity to the ceiling. The light from each linear light source strikes the lightly colored surface 14 of one of the rails and the darkly colored surface 12 of the respective facing rail. The baffle operates in the manner already described to reduce light reflections from the screens of one or more visual display terminals situated below the light sources and baffle and to maintain adequate lighting.

Figure 5:
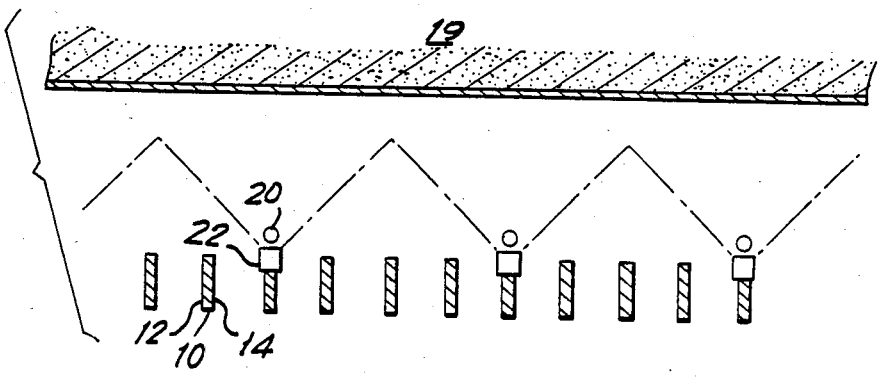
FIG. 5 shows a further embodiment of the present invention having a baffle with a linear light source supported on selected rails of the baffle.

FIG. 5 shows another embodiment of the present invention in which the baffle is suspended some distance below the ceiling. This embodiment includes linear light sources 20 mounted on support structures 22 carried by selected rails of the baffle and running parallel to the rails. The light sources direct their output upwardly towards the ceiling 19 and illuminate the room by indirect lighting reflected from the ceiling. The baffle has alternating light and dark surfaces, as in the arrangments shown in FIGS. 1–4, and controls the indirect light reflected from the ceiling in the same manner as described with respect to the arrangements of FIGS. 1 and 4 to reduce reflections from the visual display terminal screen and maintain adequate lighting.

Figure 6:
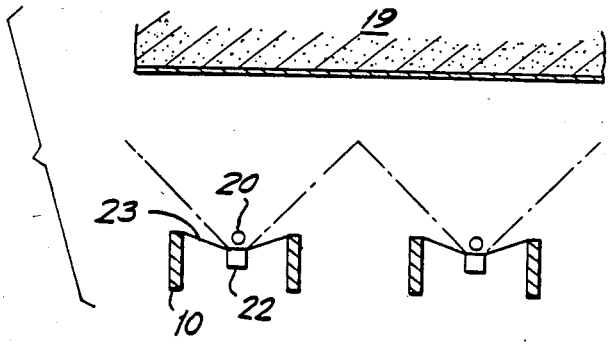
FIGS. 6 and 7 show two views of a further embodiment of the present invention having linear light sources suspended between the rails forming the baffle.
Figure 7:
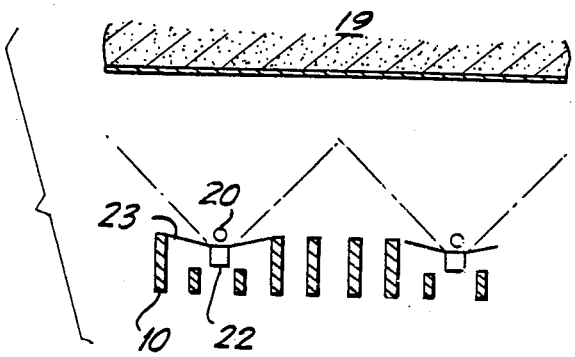

FIGS. 6 and 7 show arrangements of light sources and baffles similar to that of FIG. 5, except that the light sources are suspended between rails of the baffle. Suspension of the light sources can be accomplished by any well-known technique, for example, using metal, wood, or plastic supports 23.

Figure 8:
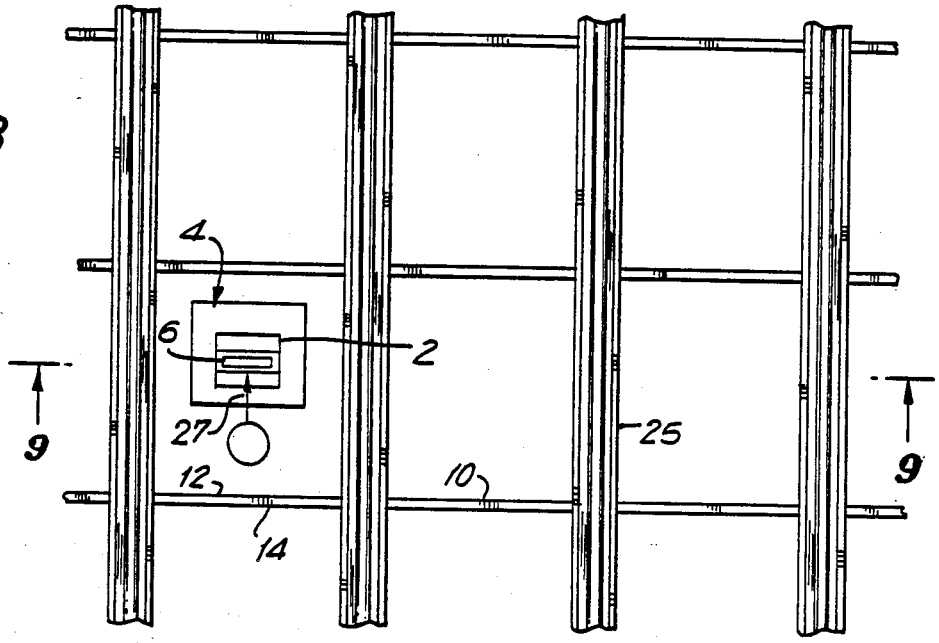
FIGS. 8 and 9 are top and section views, respectively, of another embodiment of the present invention having a baffle and linear light sources disposed perpendicular to the rails of the baffle.
Figure 9:
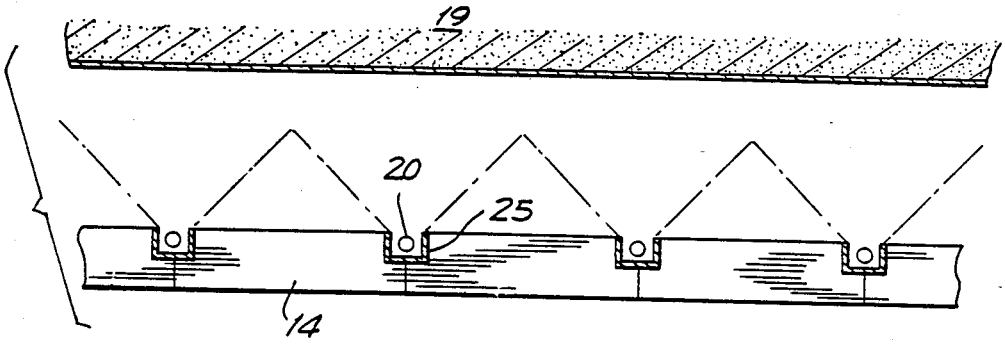

FIGS. 8 and 9 show an arrangement similar to that of FIG. 5, except that the light sources 20 are disposed perpendicular to the rails of the baffle. A suitable reflector 25 is provided for each light source to direct the output of the light source towards the ceiling. FIG. 8 shows the orientation of one visual display terminal 2 and screen 6 in relation to the light sources housed in reflectors 25 and rails 10. The operator faces the visual display terminal screen as shown by the general direction of arrow 27 in FIG. 8.

Figure 10:
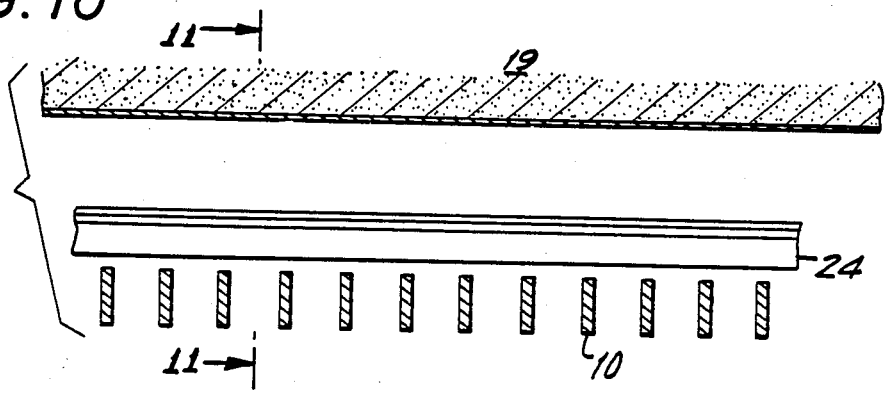
FIGS. 10 and 11 are two views of another embodiment of the present invention having a baffle and linear light sources to the sides or edges of the space where one or more visual display terminals are situated, wherein the light sources are disposed perpendicular to the rails forming the baffle.
Figure 11:
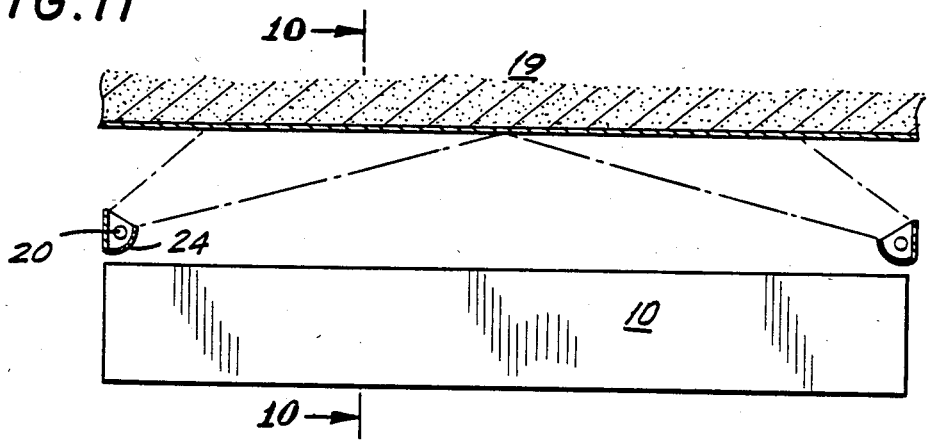

FIGS. 10 and 11 show a modification of the arrangement shown in FIGS. 8 and 9. This arrangement includes linear light sources 20 mounted near the edges of the space where one or more visual display terminals are situated and running perpendicular to the rails 10 of the baffle. Each light source includes a reflector 24 of any appropriate design well-known to those skilled in the art to direct the output of the light source upwards towards the center of the ceiling 19.

Figure 12:
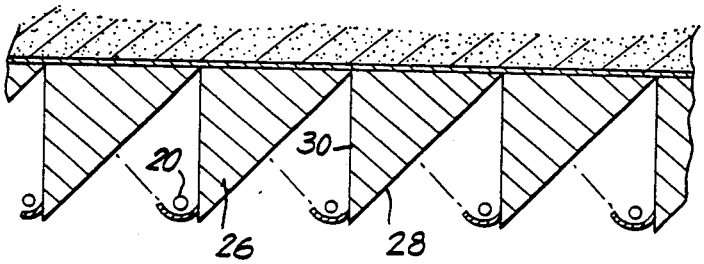
FIG. 12 is another embodiment of the present invention including a baffle in the form of a sawtooth shaped ceiling and linear light sources attached to each sawtooth.

FIG. 12 shows an embodiment of the present invention wherein the baffle comprises a series of rails disposed to form a ceiling having a sawtooth cross section. Each sawtooth 26 has a diagonally disposed surface 28 and a vertically disposed surface 30. As in the other embodiments described above and depicted in FIGS. 1–11, in the embodiment of FIG. 12, the surface 30 of each sawtooth is darkly colored to reduce light reflections in the screen of the visual display terminal; the diagonal surface 28 of each sawtooth is lightly colored to provide reflected light. The light sources comprise linear light sources 20 disposed parallel to preferably each sawtooth and attached thereto in any well-known manner. Preferably, a reflector 32 is associated with each light source to direct its light upwardly into the space between adjacent sawteeth, as shown. Reference numeral 32 can also represent a non-reflecting shield which prevents direct downward light from the source from reaching the areas where one or more visual display terminals are situated.

Figure 13:
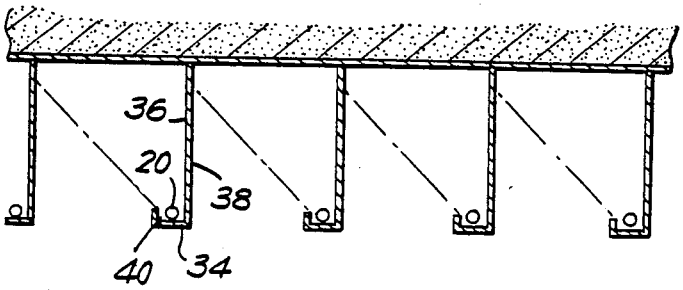
FIG. 13 is another embodiment of the present invention showing the baffle in the form of L-shaped members supporting linear light sources.

FIG. 13 shows an embodiment of the invention wherein the baffle is in the form of a series of L-shaped members 34. As in the embodiments of FIGS. 1–12, the first surface 36 of each such member in FIG. 13 is darkly colored and the second surface 38 of each is lightly colored. A linear light source 20 is supported in trough 40 of each L-shaped member and is disposed parallel to surfaces 36 and 38, as shown. This embodiment operates in the same manner as the other embodiments to reduce reflections in the screen of the visual display terminal and to provide adequate lighting.

I claim:

1. An overhead lighting system for one or more visual display terminals each having a display screen facing in a single predetermined direction in a space where said one or more visual display terminals are situated comprising, a luminous element mounted above the one or more visual display terminals and a baffle means mounted at least partially below said luminous element for reducing reflections of overhead surfaces and said luminuous element in the screen of said one or more visual display terminals, wherein said baffle comprises a plurality of substantially parallel rails disposed generally parallel to the face of each of said display screens, each rail having a first light absorbing surface and a second light reflecting surface, said light absorbing surfaces of said rails being generally disposed facing said screen to reduce reflections from the screen.

2. The lighting system of claim 1, wherein said luminous element comprises one or more primary light sources.

3. The lighting system of claim 2, wherein said light sources are linear light sources.

4. The lighting system of claim 3, wherein said one or more linear light sources are disposed generally parallel to said rails.

5. The lighting system of claim 3, wherein said one or more linear light sources are disposed generally perpendicular to said rails.

6. The lighting system of claim 3, wherein said one or more linear light sources are mounted to the sides of said space where said one or more visual display terminals are situated.

7. The lighting system of claim 2, wherein said rails are disposed to form a sawtooth-shaped ceiling above said visual display terminal.

8. The lighting system of claim 2, wherein said rails form L-shaped members supporting said light sources.

9. The lighting system of claim 2, wherein said one or more light sources are mounted on one or more of said rails.

10. The lighting system of claim 2, wherein said one or more light sources are suspended between predetermined rails of said baffle.

11. The lighting system of claim 2, wherein said baffle is ceiling mounted.

12. The lighting system of claim 1, wherein said luminous element is a secondary light source.

13. The lighting system of claim 12, wherein said secondary light source is a reflective surface.

14. The lighting system of claim 12, wherein said secondary light source is a transilluminated surface.

* * * * *